US008172667B2

(12) United States Patent
Chim

(10) Patent No.: US 8,172,667 B2
(45) Date of Patent: May 8, 2012

(54) GAMING SYSTEM AND METHOD HAVING A SKILL FACTOR

(75) Inventor: Chi We Chim, Sydney (AU)

(73) Assignee: Aristocrat Technologies Australia Pty Limited (AU)

( * ) Notice: Subject to any disclaimer, the term of this patent is extended or adjusted under 35 U.S.C. 154(b) by 436 days.

(21) Appl. No.: 12/421,279

(22) Filed: Apr. 9, 2009

(65) Prior Publication Data

US 2009/0258696 A1 Oct. 15, 2009

(30) Foreign Application Priority Data

Apr. 11, 2008 (AU) ..... 2008901804

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 6,206,372 | B1 | 3/2001 | Harris | |
| 7,179,166 | B1 * | 2/2007 | Abbott | 463/9 |
| 2005/0181861 | A1 | 8/2005 | Kodachi | |
| 2006/0148553 | A1 | 7/2006 | Dodge | |
| 2007/0203971 | A1 * | 8/2007 | Walker et al. | 709/201 |
| 2007/0232387 | A1 | 10/2007 | Pace | |

* cited by examiner

*Primary Examiner* — William D Coleman
(74) *Attorney, Agent, or Firm* — McAndrews, Held & Malloy, Ltd.

(57) ABSTRACT

A gaming system comprises a game controller arranged to control play of a game having a player skill aspect, and a display arranged to display a representation of the game, the game controller being arranged to control the display to display a set of symbols for selection, the game controller being responsive to the player skill aspect to facilitate selection of at least one of the symbols, a skill level factor of the player skill aspect being variable depending on operation of a game, whereby to vary a skill level required by the player.

15 Claims, 7 Drawing Sheets

GAMING SYSTEM AND METHOD HAVING A SKILL FACTOR

RELATED APPLICATIONS

This application claims priority to Australia Provisional Patent Application No. 2008901804 having a filing date of Apr. 11, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly select and cause the display of several symbols from a predetermined set of symbols, and to determine a game outcome, such as a game win, based on the displayed symbols. Such gaming systems may commonly be implemented as a stepping machine provided with mechanical reels that each carry several symbols of the set, or a video machine wherein selected symbols are displayed on virtual reels on a graphical display device. Win outcomes can occur based on symbols appearing in one or more horizontal lines, diagonal lines, or any other predetermined way. Typically five vertically aligned reels are provided on the display (although less or more may be provided). Each reel displays three symbols high in the display window for the reel (although, again, this may be more or less symbols high).

Many gaming machines are of the type where the game outcome (selection of symbols) is totally randomly generated, usually on the basis of a random number generator selecting symbols from a symbol table (cross referenced with random numbers). Other types of gaming system are known where player interaction is required to facilitate selection of symbols. For example, "Pachislo" games require a player to push a button which causes the spinning reels to come to a stop.

Pachislo and other types of "skill stop" games rely on a certain amount of player skill to enable the player to stop the reel (virtual or actual) to select the symbol they desire for the desired game outcome. These types of gaming systems may not wholly depend on player skill. A group of symbols may be pre-selected, for example by utilizing a random number generator, and the player skill stop may only be exercised to select from these "pre-selected" symbols. It may appear to the player that he has more than this group of symbols to select from, but the gaming machine will only allow one or more of these symbols to be selected. The gaming machine operates to maintain the return to player (rtp) specified by the operator.

Skill stop games generally use a "slip" system. When the player pushes a button to stop the reels, the reel can stop plus or minus a couple of symbols on the reels. For example, let us say the reel carries symbol numbers "1", "2", "3", "4", "5", "6", "7", "8", and "9". If the player pushes a "stop" button when the "5" is shown on a gaming machine display, when the reel comes to rest it may be "5", "4", "3" or "2".

In skill stop games, it is known to vary the rotation speed (or apparent rotation speed, if a virtual reel) of a reel in order to vary the skill level requirement of a player attempting to stop the reel on a desired symbol. For example, in some circumstances a reel may be slowed down so that it is easier for a player to make reel stop predictions. A determination as to when to vary the speed of rotation of the reel is usually made by an internal decision of the gaming machine.

While such gaming systems provide users with enjoyment, a need exists for alternative gaming systems in order to maintain or increase player enjoyment.

BRIEF SUMMARY OF THE INVENTION

In accordance with a first aspect, the present invention provides a gaming system, comprising a game controller arranged to control play of a game having a player skill aspect, and a display arranged to display a representation of the game, the game controller being arranged to control the display to display a set of symbols for selection, the game controller being responsive to the player skill aspect to facilitate selection of at least one of the symbols, a skill level factor of the player skill aspect being variable depending on operation of a game, whereby to vary a skill level required by the player.

In an embodiment, the game operation is an operation of a first game and the game having the skill aspect is a second game.

In an alternative embodiment, the game operation is an operation of the same game as the skill aspect game.

In an embodiment, the game operation is operation of a base game, and the game having the skill aspect is a feature game generated by the base game.

In an embodiment, the game operation is a game outcome. The game outcome may operate as a trigger to vary the skill level factor. The trigger may be a combination of symbols on a line or scatter, a single symbol, or any other trigger.

In an embodiment, there are a plurality of skill level factors which may be varied.

In an embodiment, the player skill aspect is a symbol selection skill. The player is presented with a plurality of symbols and is required to exercise skill in the selection of at least one of the symbols. In an embodiment, the game in which the skill aspect is implemented is a reel game. The reel may be a virtual reel or an actual reel. In this embodiment, the skill aspect is a skill stop. The player is required to exercise skill in stopping the reel at the symbol that they may require, e.g. to attain a "Win" combination of symbols. The player may be required to exercise skill in stopping more than one reel. In an embodiment, the skill level factor is reel speed, the reel speed being variable. In an embodiment, the skill level factor relates to apparentness of "tells". Tells are indicators which provide information to the player about when a required symbol is due to appear. For example, tells may include a chain of predetermined symbols which precede the required symbol. When a player starts seeing the chain of tell symbols, he knows that a required symbol is about to appear and that it may be time to operate the skill stop. Varying the skill level factor for tells may comprise varying the brightness of the tells. For example, where the tells comprise a chain of symbols, their brightness may be varied to vary the skill level factor required by the player (may be made brighter to make it easier for the player to spot the tells). In an embodiment, the skill level factor is reel "slip" Varying the skill level factor may comprise varying the amount of reel slip. To increase the player's chances of selecting a required symbol by skill stop, the reel slip may be decreased, for example.

In an embodiment, the gaming system comprises an indicator indicating a status of the skill level factor. The indicator may provide an indication of skill level required or attained.

In an embodiment, game outcomes may result in the award of credit to a player. In an embodiment, the game may be played utilizing player credit. In an embodiment, a player interface is provided enabling player credit to allocated.

It is preferably an advantage of at least an embodiment of the invention, that skill level factors may be varied depending upon outcomes of a game. For example, where a base game generates the skill aspect game as a feature game, an outcome of the base game may set skill level factors for the feature game. As another example, where the skill level aspect game and the game the outcome of which varies the skill level factor are the same game, the skill level factor may be varied depending on symbol combinations occurring within the game, in order to improve the player's chances of obtaining wins.

It is preferably an advantage of at least an embodiment of the invention that a player can see the skill level factors changing and therefore his chances of winning the game improving, depending on ongoing play of the game. This provides a more interesting gaming experience for the player.

In accordance with a second aspect, the present invention provides a method of gaming, comprising the steps of displaying a set of symbols for selection, facilitating selection of a least one of the symbols responsive to a player skill aspect, and varying a skill level factor of the player skill aspect independence on operation of a game, whereby to vary a skill level required by the player.

In accordance with a third aspect, the present invention provides a game controller for a gaming device, the game controller arranged to control play of a game having a player skill aspect and further arranged to display on a display of the gaming device a set of symbols for selection, the game controller being responsive to the player skill aspect to facilitate selection of at least one of the symbols, a skill level factor of the player skill aspect being variable whereby to vary a skill level required by the player, the display being arranged to display a status of the skill level factor.

The display may comprise an indicator which indicates the status of the player skill level factor. This has the advantage, in at least an embodiment of the invention, that a player can determine how well a game is playing. In an embodiment, the indicator is a separate indicator from the display of the gaming symbols.

In accordance with a fourth aspect, the present invention provides a method of gaming, comprising the steps of displaying a set of symbols for selection, facilitating selection of at least one of the symbols responsive to a player skill aspect, varying a skill level factor of the player skill aspect whereby to vary a skill level required by the player, and displaying a status of the skill level factor.

In accordance with a fifth aspect, the present invention provides a computer program comprising instructions for controlling a computer to implement a gaming system/controller in accordance with the first or third aspects of the invention.

In accordance with a sixth aspect, the present invention provides a computer readable medium providing a computer program in accordance with the fifth aspect of the invention.

In accordance with a seventh aspect, the present invention provides a data signal comprising a computer program in accordance with the fifth aspect of the invention.

In accordance with an eighth aspect, the present invention provides a game controller for a gaming device, the game controller arranged to control play of a game having a player skill aspect and display on a display of the gaming device a representation of the game, the game controller being further arranged to control the display to display a set of symbols for selection, the game controller being responsive to the player skill aspect to facilitate selection of at least one of the symbols, a skill level factor of the player skill aspect being variable depending on operation of a game, whereby to vary a skill level required by the player.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which.

DETAILED DESCRIPTION OF THE INVENTION

Figure 1:
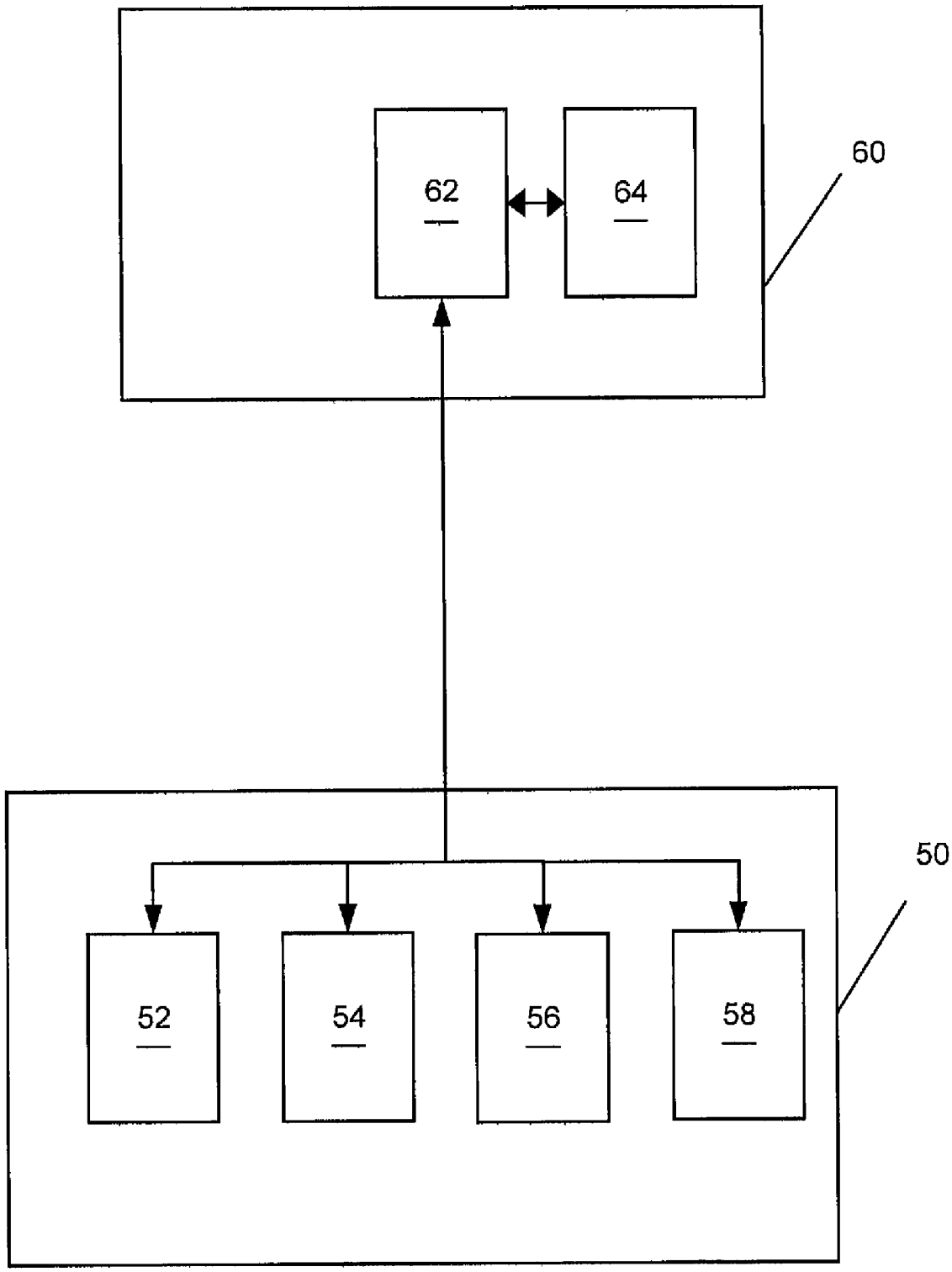
FIG. 1 is a block diagram of the core components of a gaming system.

Referring to the drawings, there is shown a gaming system arranged to implement a game which has a player skill aspect. In this embodiment, the player skill aspect is a symbol selection skill. The player is presented with a plurality of symbols and is required to exercise skill in the selection of at least one of the symbols. In the following examples, the skill is a reel stop skill of a reel based symbol system. Skill level factors, such as speed of rotation of the reels, are variable depending on operation of the gaming system, and in this embodiment depending upon outcomes of games played by the gaming system.

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58. In this embodiment, the game play mechanism 56 includes one or more skill stop controls to facilitate player interaction with symbol selection for the game.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
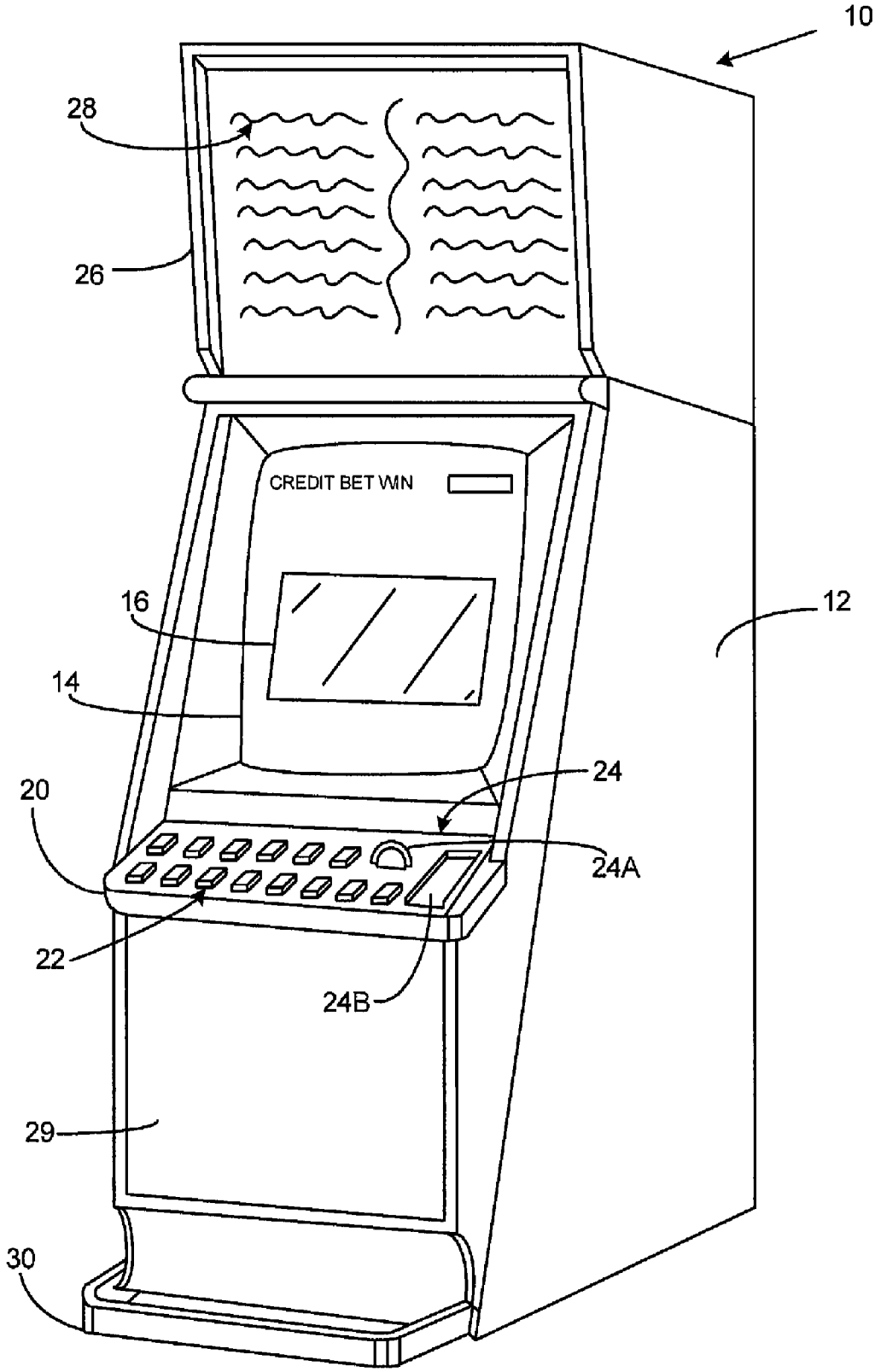
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. A bank of buttons 22A is provided on the mid-trim 20, for enabling the player to implement a skill stop operation. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
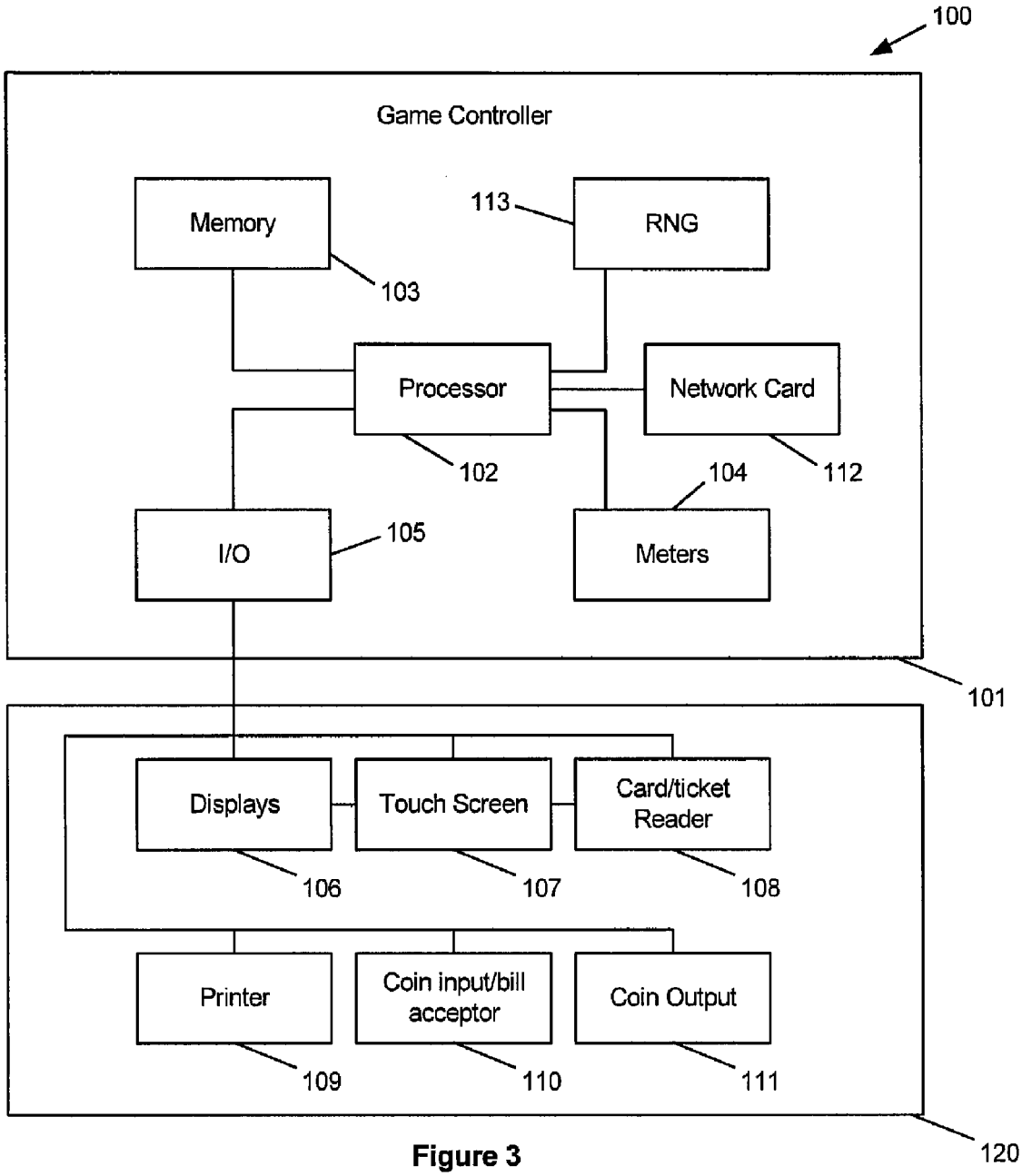
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107 (including skill stop controls), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
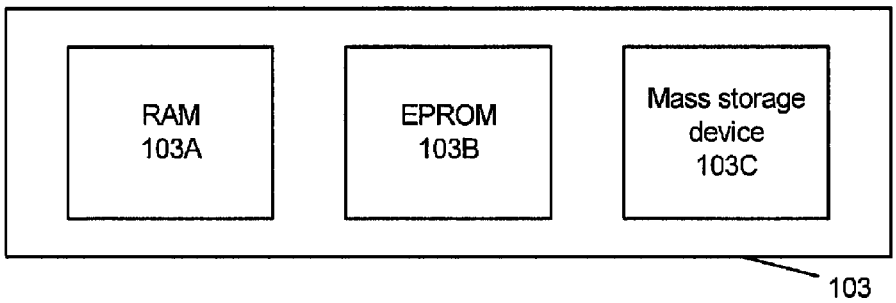
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
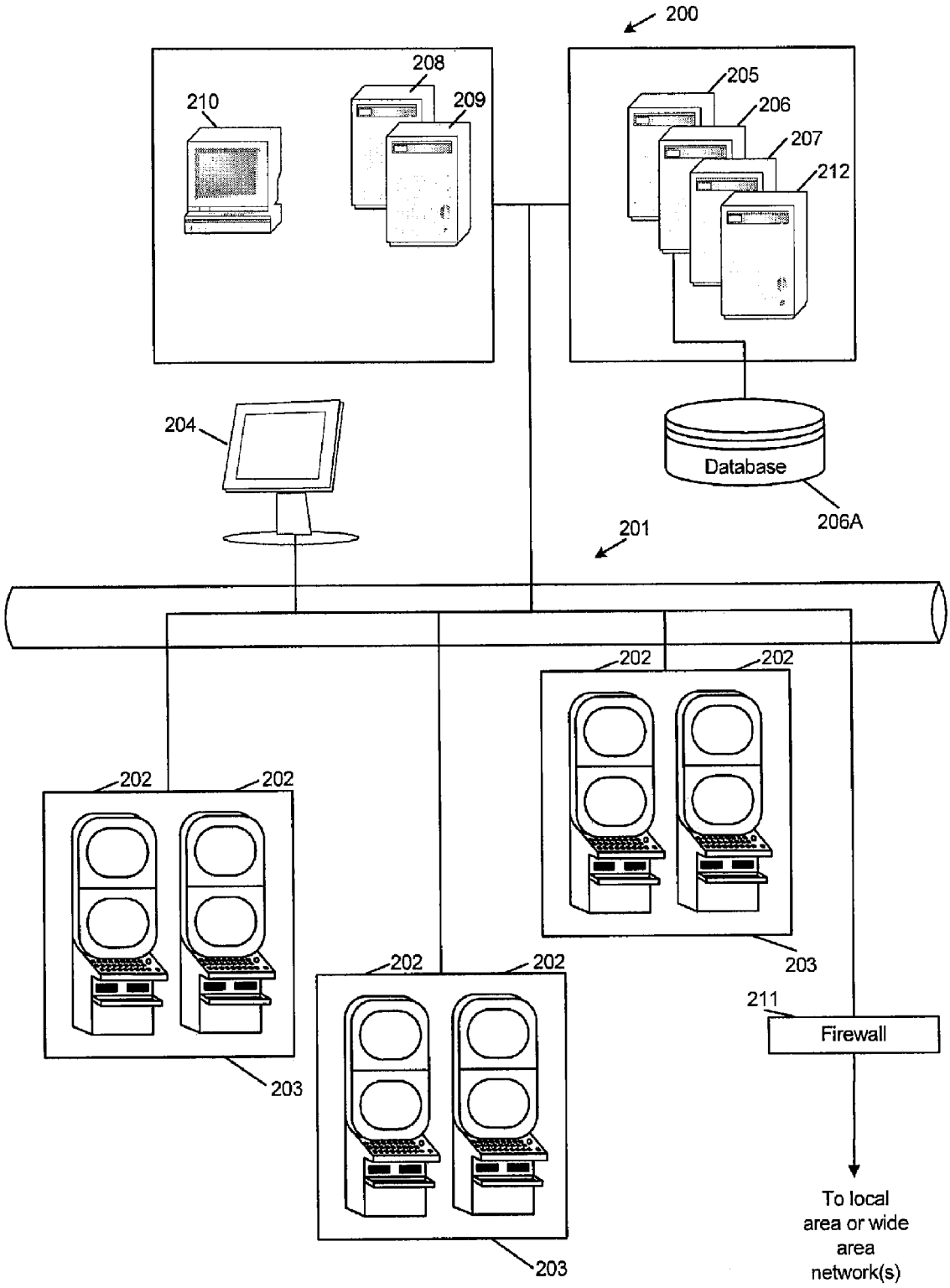
FIG. 5 is a schematic diagram of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Figure 6:
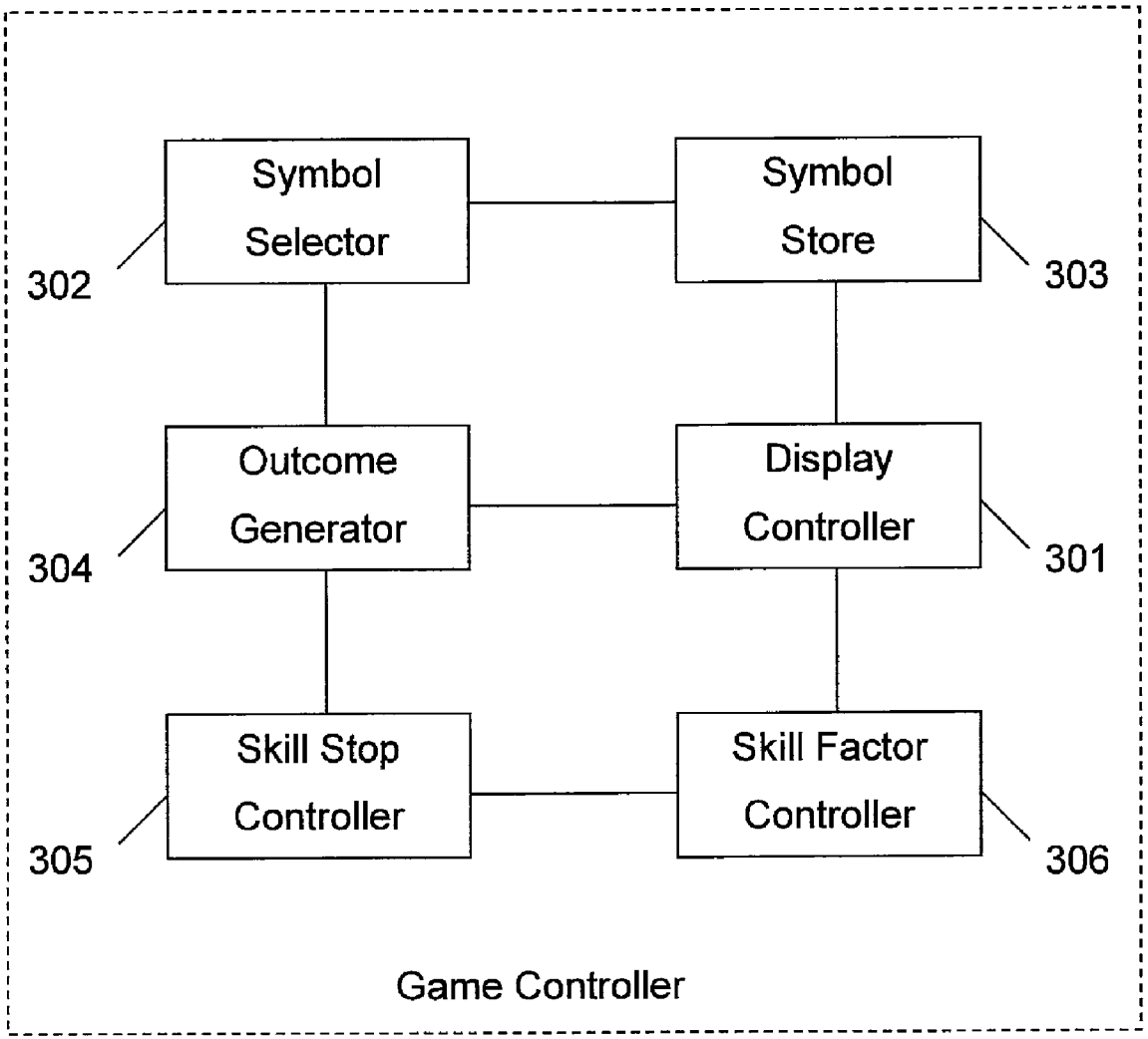
FIG. 6 is a schematic diagram of functional components of a gaming system in accordance with an embodiment of the present invention.

Referring to FIG. 6, the functionality of embodiments of the present invention may be implemented by a game controller 300 having the functional components illustrated. In this embodiment, the functional components are implemented utilizing a processor and memory (such as processor 102 and memory 103 in FIG. 3, or processor 62 and memory 64 in FIG. 1, for the game server 205 in FIG. 5), and associated programming. Other implementations are envisaged. For example the functional blocks of FIG. 6 may be implemented in hardware as separate units, or a combination of hardware and software as separate units. Any practical implementation of these functional units may be employed.

In this embodiment, the game controller 300 is arranged to control the gaming system to play a game which comprises selection of a plurality of symbols from a set of symbols. The game is implemented as a "reel" game. The game controller 300 comprises a display controller 301 which is arranged to control the display (reference numerals 54, 14, 106, 204 of previous figures) to emulate a representation of reels bearing symbols. Alternatively, the display may comprise a stepper motor and physical reels bearing the symbols.

The game controller 300 includes a symbol selector 302 which is arranged to select a plurality of symbols from a set of symbols available in a symbol store 303. An outcome generator 304 is arranged to determine an outcome of the game. In this embodiment, the outcome of the game depends on the selected symbols and may include a win outcome, loss outcome, trigger outcome, a feature outcome or other outcome. Outcomes may be determined on the basis of symbols appearing in one or more horizontal lines, diagonal lines, or any other pre-determined combinations.

Game controller 300 also includes a skill stop controller 305. The skill stop controller 305 is responsive to skill stop controls that may be manipulated by a player. In this embodiment the skill stop controller 305 provides the final selection of one or more symbols. The symbol selector, when skill stop is operational, may narrow a selection of symbols and the skill stop controller then selects the symbol from this narrowed selection.

The game controller 300 also comprises a skill factor controller 306. In this embodiment, the skill stop has a plurality of skill factors. These comprise:

1. Reelspeed
2. Apparentness of tells
3. Reel slip.

The skill factor controller 306 controls variation in the skill factors.

Figure 7:
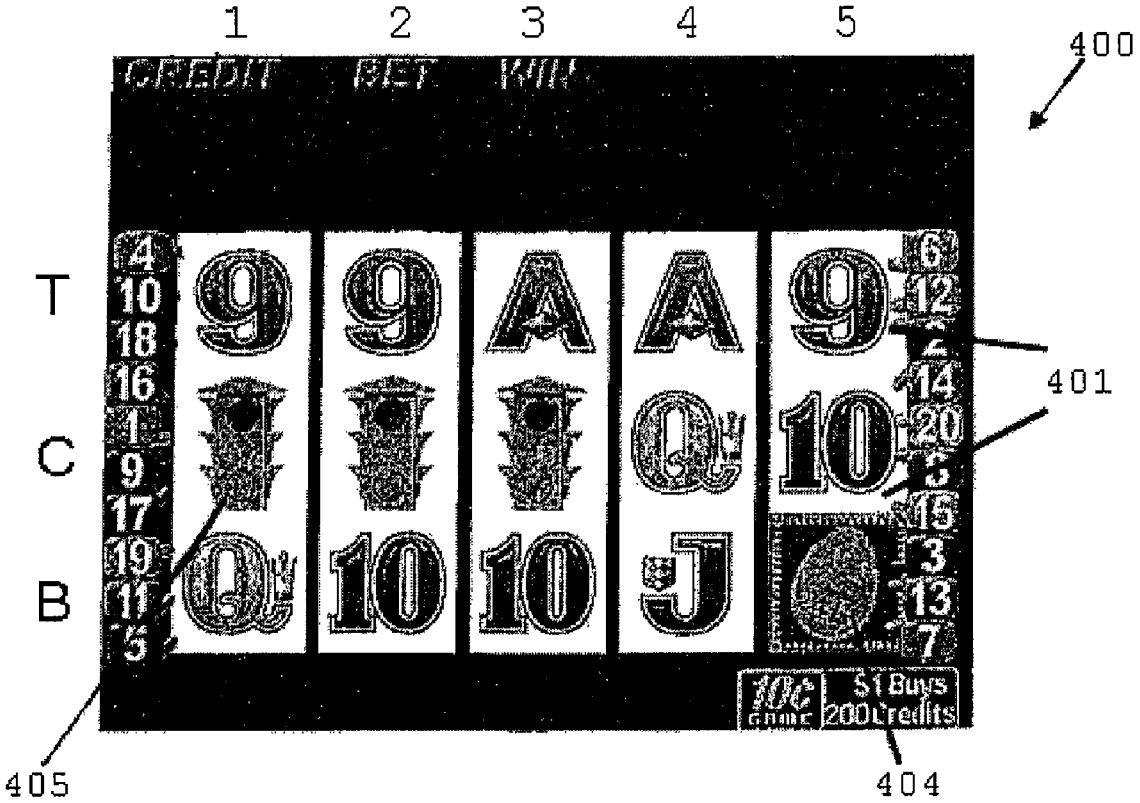
FIGS. 7 and 8 are representations of example displays generated by a gaming system in accordance with an embodiment of the present invention; and, FIG. 9 is a flow diagram illustrating operation of a gaming system in accordance with an embodiment of the present invention.

FIG. 7 shows a representation of a gaming machine display 400 which, in the example shown, has five reels (numbered "1" to "5"). The display 400 shows three reel positions high when the reels have stopped/the symbols have been selected. The reel positions are designated Bottom ("B"), Centre ("C") and Top ("T"). This is a typical reel-type display for a gaming machine. It will be appreciated that in other embodiments the number of reel positions may be more or less than in display 400. Also the number of reels may be more or less than in the display 400.

The reels may be virtual reels, generated as a video display from the selected symbols, actual mechanical reels carrying the symbols and driven by a stepper motor, or any other reel arrangement or emulation. In the case of actual physical reels, the game controller drives a stepper motor to randomly select the symbols appearing in the display 400.

A game outcome is determined by the outcome generator 304 based on combinations of symbols selected and appearing in the display 400. The symbols may be any symbols. As will be appreciated, many different types of symbols are used in gaming systems. A set of symbols may include standard symbols and function symbols. For example, standard symbols may resemble fruit such as apples, pears and bananas with a win outcome being determined when a predetermined number of the same fruit appear on a display in the same line, scattered, and so on. The function associated with a function symbol may be a "wild" function wherein display of the function symbol is treated during consideration of the game outcome as any of the standard symbols. Other functions may include scatter functions, multiplier functions, repeat win functions, jackpot functions and feature commencement functions.

In the example shown in FIG. 7, the symbols are representations of cards. In this example, a winning hand appearing on the C line may cause the outcome generator to determine that a Win has occurred and that an appropriate prize may be awarded. For example, five of a kind (e.g. 5 jacks "J". 5 tens "10" etc) on the C line may result in a win.

In addition to the card symbols there are other symbols, including "traffic light" 405 symbols which may be function symbols and also "wild card" symbols 404. In this example, there are also "jackpot" symbols which, when selected, enable a jackpot prize to be awarded.

The diagram shown in FIG. 7 is one way of representing the symbols only. It will be appreciated that in other embodiments of the invention symbols may be represented in different ways, using any type of fancy artwork, or in any appropriate manner.

Games are operated based on player credit (which may be accumulated from previous games or may be entered by the player either as cash or from a player account). The player's win entitlement may vary from game to game and may or may not be dependent on player selections. In most spinning reel games, it is typical for the player entitlement to be effected by the amount they wager and selections they make (i.e. the nature of the wager). For example, a player's win entitlement may be based on how many lines they wager on in each game—i.e. minimum of one line up to maximum number of lines allowed by the game (noting that not all permutations of win lines may be available for selection). Such win lines are typically formed by a combination of displayed symbol positions, one from each reel, the symbol positions being located relative to one another such that they form a line.

In many games, the player's win entitlement is not strictly limited to the lines they have selected. For example, "scatter" pays are awarded independently of player's selection of pay lines and are an inherent part of the win entitlement.

Operation of an embodiment of the present invention will now be described with reference to FIGS. 7 through 9.

Referring to FIG. 7, the symbol selector 302 selects a plurality of symbols from symbols available in the symbol store 303. The game controller 300 operates via the display controller 301 to emulate spinning of reels in the display 400. If a skill stop feature of the game is operating, the symbol selector 302 selects groups of symbols which may subsequently be used in a skill stop selection by the player. The player operates the skill stop controls (e.g. 22A of FIG. 2) to stop the reel. The symbols thus selected are then utilized to determine a game outcome. In some cases, the reel stop feature may not be operating, in which case the selection of the symbols is made purely by the symbol selector 302. A game outcome is determined by the outcome generator 304 depending upon line or scatter combinations (or other features, such as bonus awards) of the symbols appearing in the display 400.

In this embodiment, the skill of the game relates to the player's ability to be able to stop the reels on the desired symbols by operation of the skill stop controls (in this embodiment being buttons 22A associated with each individual reel). For example, to achieve a win, a player may require a line of winning symbols e.g. a line of traffic lights 405. The player will be made aware when the likelihood of a win is available (as is known with Pachislo machines, for example) and then knows that he must exercise his skill in operation of the skill stop control to stop the reels so that the appropriate line of traffic light symbols is formed. It will be appreciated by the skilled person that many combinations of symbols on lines or scatters may achieve a win and the invention is not limited to a line of traffic light symbols.

In this embodiment, the player must push the skill stop control at a time when they predict the desired symbol is coming up. A certain amount of reel slip is applied, so that there is a delay between the player pushing the skill stop button and the stopping of the reel. Further, a number of "tell" symbols are provided preceding the winning symbol. In this embodiment, the tell symbols comprise lighting the symbols preceding the desired symbol (e.g. four or five symbols preceding the desired symbol) on the reel, so that the player is given an indication when the required symbol is upcoming.

In accordance with this embodiment, the game controller 300 provides for variation in three skill level factors. The three skill level factors are:

A. Reel spin speed

B. Apparentness of tell symbols

C. Reel slip.

In accordance with the present invention, these skill level factors are varied in dependence on preceding game outcomes. In this embodiment, a preceding game outcome, such as a trigger symbol appearing in the display, or a combination of symbols, leads to an adjustment in the skill level factor. As well as outcomes of the game, triggers may alternative or additionally include a measurement of time that the player has been playing the machine, a particular amount of waiting activity on the machine, it may be based on player tracking information, or may be a random event. It may be based on an amount of credit bet by a player. For example, the more credit bet, then a skill level factor is adjusted in favor of the player. The ability to buy changes in skill level factor may solve a perceived problem with the chance of winning jackpots. A problem in the prior art with jackpots is that the win of a jackpot is generally independent of the credit units wagered by a player. Players who are willing to bet more credits to win a jackpot e.g. more credits per line, have only as much chance as a player who is willing to bet only a small number of credits per line. This is perceived as being unfair to players who are willing to gamble higher (in order to win the jackpot) than other players. In this embodiment, the player who bets more credits receives a more favorable skill level factor, giving them a better chance to obtain jackpot symbols, for example, and therefore a better chance of winning a jackpot.

In this embodiment, the trigger is a game outcome and the player needs to spin up a trigger symbol (can be any symbol e.g. the "egg" 404 on any one of reels 1, 2, 3, 4 or 5) to result in an adjustment of one of the skill level factors.

Figure 8:
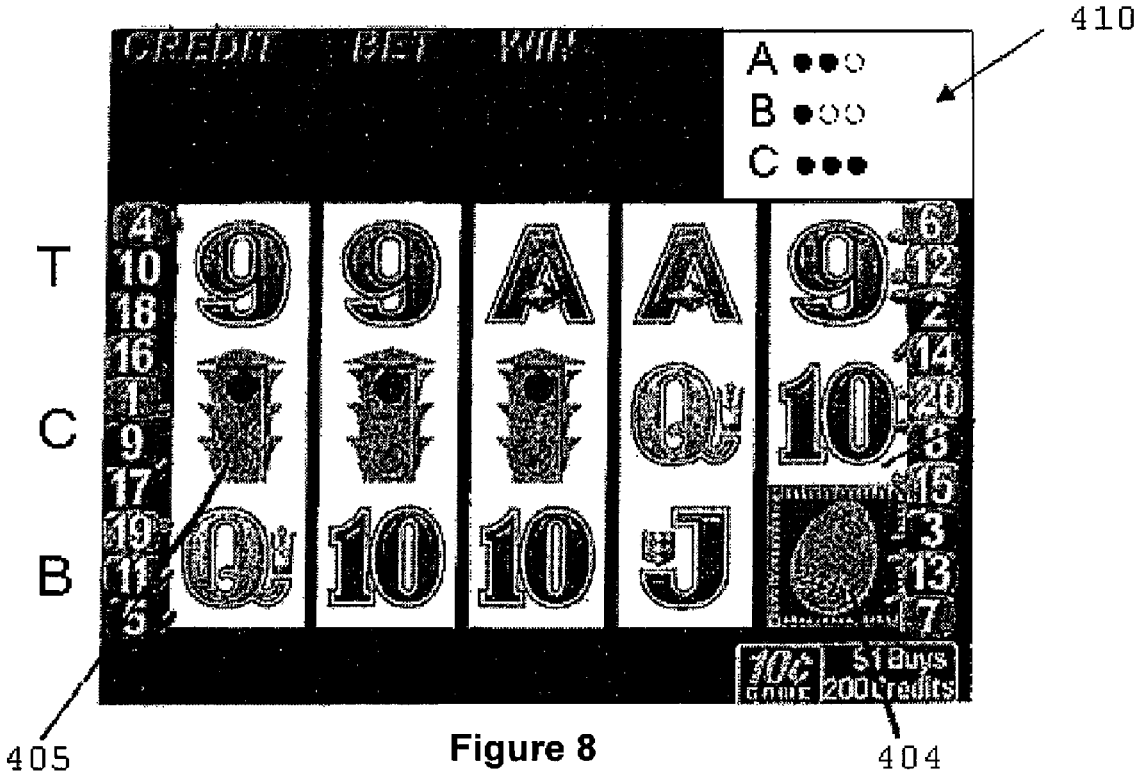

Referring to FIG. 8, the display screen also displays an indicator indicating a status of the skill level factors. The indicator 410 in this embodiment includes a series of "bubbles" that are either filled (shaded in the figure) or not filled (not shaded in the figure) to indicate status of the skill level factor A (reel speed), B (apparentness of tell symbols) and C (reel slip).

In the example shown, the game is rating a "2" (two bubbles filled in indicator 410) for the reel speed factor. The gaming system is controlled so that the reel speed is slowed in accordance with the skill level factor "2" in order to give the player a better chance of being able to see the symbols on the reel as they rotate, making it easier to exercise skill stop.

The indicator is showing a rating of "1" for the tell apparentness skill level factor. The brightness of tell symbols preceding the required symbol is increased.

A level "3" is indicated for the slip skill level factor. Slip of the reels following actuation of the reel stop control is therefore decreased, giving the player more chance of obtaining the required symbol by skill stop.

The indicator 410 therefore provides information to the player about how well the gaming system is paying, i.e. how easy it would be for him to stop reels on symbols he desires for a win.

The indicator 410 is not limited to a "bubble" type indicator, as shown in this embodiment. It may be any display e.g. a dial display, a display of a number showing the skill level factor. Also, the skill level factor is not limited to three levels. There may be more or less levels, or the skill level factor may be shown as an analogue display and may be an analogue skill level factor (e.g. analogue change of reel speed).

The skill level factor indicator may be displayed by the same display as the reel display, or another display, e.g. on the top box of the machine, or elsewhere.

The game starts with none of the bubbles filled on the skill factor level indicator. In the presently described embodiment, the player "earns" these by spinning up trigger symbols e.g. an "X" symbol on any of reels 1, 2, 3, 4, 5. Different symbols may be required for different skill level factors. For example an "egg" may be the "X" symbol for skill level factor A, a Queen "Q" for skill level B and a traffic light for skill level factor C.

When a player win occurs (e.g. a large win or a jackpot, for example), the system is arranged to reset the skill level factor status to zero and the player starts a new game. In alternative embodiments, other game outcomes may result in resetting the skill level factor status. In further alternative embodiments, other triggers may result in resetting of the skill level factor status. In some embodiments, triggers, such as amount of credit, symbols appearing in the display, etc, may adjust the skill level factor status downwardly (to the disadvantage of the player).

In the above embodiment, the game which varies the skill level factors is the same game. In alternative embodiment, a game varying the skill level factors may be a base game and a feature game is played with the varied skill level factors. That is, a base game may be played to generate a different status of skill level factors. A trigger may occur for a feature game, and this feature game may be played with the skill stop feature and varied skill level factors. In this case the base game may not be a skill stop game (although in an alternative embodiment is could also be a skill stop game).

Figure 9:
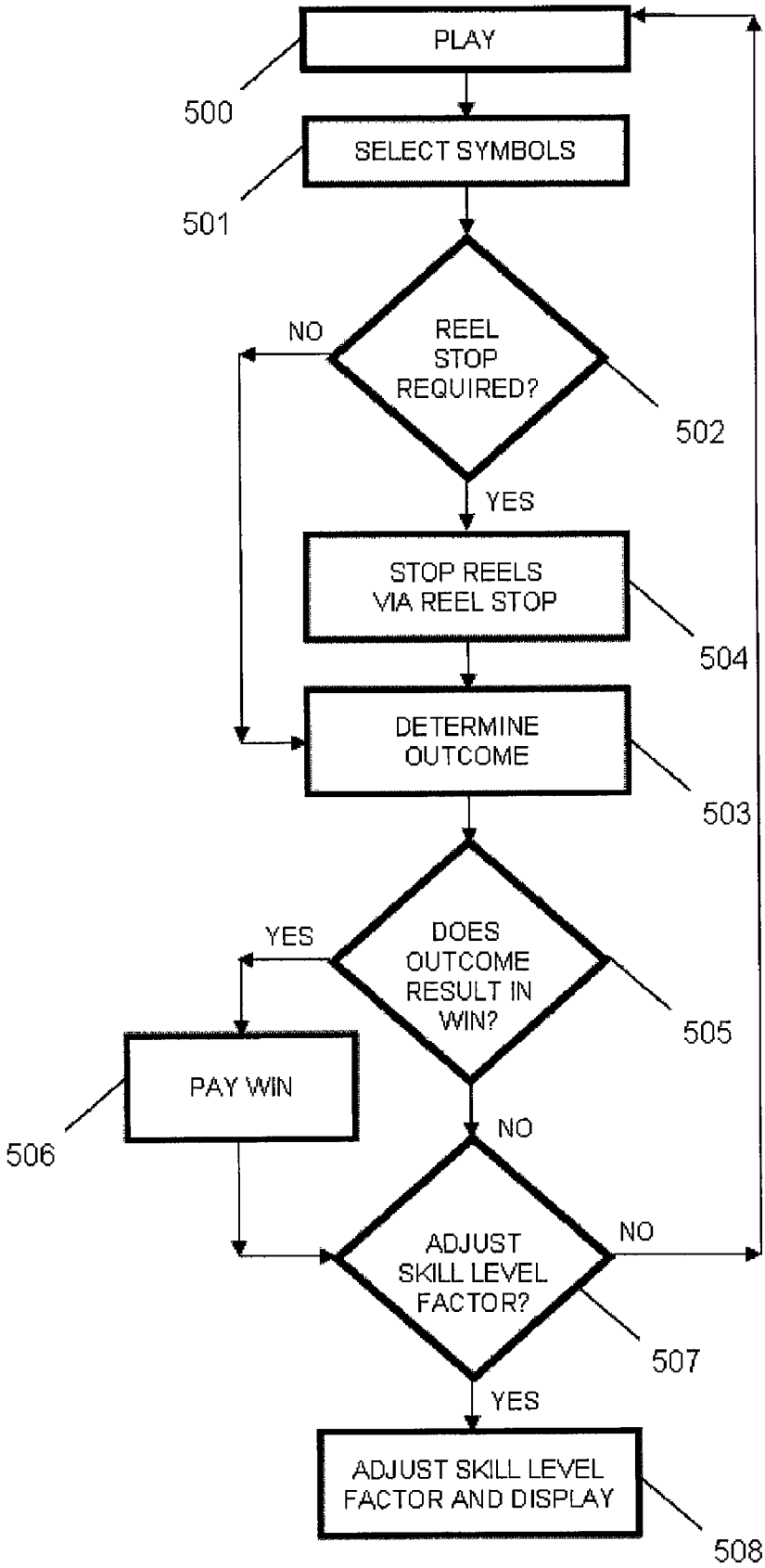

A game playing process in accordance with an embodiment of the present invention will now be summarized with reference to FIG. 9. At step 500 game play commences. At 501 the game is played by a selection of symbols from the symbol store 303 by the symbol selector 302. If game play also requires a skill stop operation by a player, the symbol selector 303 will not solely select the symbols to determine the game outcome, but will also rely on the skill stop exercise by the player to finalize the symbol selection. At step 502 a determination is made as to whether or not a skill stop is required. If "No" a game outcome is determined at 503 based on the selection of symbols by the symbol selector 302. If "Yes" at step 504 a player operates the skill stop controls. The symbols are selected and a game outcome is determined at step at 503. At step 505, the system determines whether the outcome results in a win. If "Yes", at step 506 the win is paid. If "No", no win is paid.

At step 507 a determination is made as to whether or not the game outcome results in an adjustment in the skill level factor. That is, is there a trigger from the game outcome resulting in a skill level factor adjustment. If "Yes", at 508 the skill level factor is adjusted (reel slip, reel speed or apparentness of tells) and the display is adjusted so that the indicator 401 indicates the skill level factor status. Play then returns to the first step 500.

It will be appreciated that embodiments of the invention may be implemented utilizing appropriate software and/or hardware. Program code may be supplied in a number of ways, for example on a computer readable medium, such as a disc or a memory or as a data signal (for example, by downloading it from a server).

In the above embodiment, there are three skill level factors. The invention is not limited to three skill level factors. In alternative embodiments, the game may have only one skill level factor that can be adjusted, or two or more than three.

In the above embodiment, in order to increase the apparentness of tell symbols, brightness of these symbols is increased. Apparentness of tell symbols may be varied in other ways. For example, sounds may be associated with the appearance of tell symbols and the volume of these sounds may be increased to vary the apparentness of the tell symbols. Other variations of apparentness may be implemented.

The above embodiment relates to skill stop games, where the player must exercise a certain skill in facilitating stopping of the reels to stop on a desired symbol. Non-skill stop games are known where the reel positions are generated by the gaming system, but the player is also provided with reel stop controls. The reel stop controls do not affect reel stop, however, but merely make the player believe that he has some input into stopping the reels. The present invention can be applied to these non-skill stop games. The gaming system may make it appear that skill level factors are varying e.g. reel speed, reel slip, apparentness of tell symbols, to assist the player. Even though the player skill stop does not affect the reel position, as the skill level factors increase in favor of the play, the gaming system may provide more chance that the reel positions generated (internally by the system e.g. utilizing a random number generator) stop the reels at the position desired by the player.

In the above-described embodiments, the display emulates a plurality of reels. In an alternative embodiment, the symbol selection may be implemented as actual reels driven by a stepper motor.

In the above-described embodiments, all the reels in the gaming machine are able to be stopped utilizing skill stop. The invention is not limited to this. In alternative embodiments, 1, 2 or more reels may be stopped by a skill stop, and other reels may not.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system comprising a game controller arranged to control play of a game having a player skill aspect; and a display arranged to display a representation of the game, the game controller being arranged to control the display to display a set of symbols for selection, the game controller being responsive to the player skill aspect to facilitate selection of at least one of the symbols, a skill level factor of the player skill aspect being variable depending on operation of a game, whereby to vary a skill level required by the player, and wherein the game in which the skill aspect is implemented is a reel game and the player skill aspect is skill stop of a reel, and wherein the skill level factor is reel slip.

2. A gaming system in accordance with claim 1, wherein the game operation is an operation of a first game and the game having the skill aspect is a second game.

3. A gaming system in accordance with claim 1, wherein the game operation is an operation of the same game as the skill aspect game.

4. A gaming system in accordance with claim 1, wherein the game operation is operation of a base game and the game having a skill aspect is a feature game generated by the base game.

5. A gaming system in accordance with claim 1, wherein the game operation is a game outcome.

6. A gaming system in accordance with claim 1, wherein the game operation is based on an amount of credit associated with game play.

7. A gaming system in accordance with claim 1, wherein a plurality of skill level factors are variable.

8. A gaming system in accordance with claim 1, further comprising an indicator indicating a status of the skill level factor.

9. A method of gaming, comprising the steps of displaying a set of symbols for selection;

facilitating selection of at least one of the symbols responsive to a player skill aspect; and varying a skill level factor of the player skill aspect in dependence on operation of a game, whereby to vary a skill level required by the player;

wherein the game in which the skill aspect is implemented is a reel game and the player skill aspect is skill stop of a reel, and wherein the skill level factor is reel slip.

10. A method in accordance with claim 9, wherein the game operation is an operation of a first game and the game having the skill aspect is the second game.

11. A method in accordance with claim 9, wherein the game operation is an operation of the same game as the skill aspect game.

12. A method in accordance with claim 9, wherein the game operation is an operation of a base game and the game having a skill aspect is a feature game generated by the base game.

13. A method in accordance with claim 9, wherein the game operation is a game outcome.

14. A method in accordance with claim 9, wherein the game operation is based on an amount of credit associated with game play.

15. A method in accordance with claim 9, comprising the further step of indicating a status of the skill level factor.

* * * * *